US006708736B2

(12) United States Patent
Bender

(10) Patent No.: US 6,708,736 B2
(45) Date of Patent: Mar. 23, 2004

(54) FUEL ASSEMBLY FOR AN ENGINE WELDER

(75) Inventor: David J. Bender, Chardon, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 142 days.

(21) Appl. No.: 10/099,677

(22) Filed: Mar. 14, 2002

(65) Prior Publication Data

US 2003/0201028 A1 Oct. 30, 2003

(51) Int. Cl.[7] ..... B65B 1/04; B65B 3/04; B67C 3/02

(52) U.S. Cl. ..... 141/86; 141/94; 141/95; 141/192; 141/198; 141/391

(58) Field of Search ..... 141/86, 94, 95, 141/192, 198, 391, 392; 280/834; 137/571; 220/86.2; 219/133

(56) References Cited

U.S. PATENT DOCUMENTS 5,590,806 A * 1/1997 Green et al. ..... 220/562
5,718,471 A * 2/1998 McHorse ..... 296/97.22
5,928,535 A 7/1999 Trinkner et al.
6,172,332 B1 1/2001 Trinkner et al.
6,263,926 B1 7/2001 Bender et al.
6,296,027 B1 10/2001 Bender et al.

OTHER PUBLICATIONS

Operator's Manual for the Ranger™ 9.

* cited by examiner

*Primary Examiner*—Timothy L. Maust
(74) *Attorney, Agent, or Firm*—Fay, Sharpe, Fagan, Minnich & McKee, LLP

(57) ABSTRACT

A grommet adapted to be inserted in a fueling cavity of housing of an engine driven device. The grommet is design to at least partially seal the fueling cavity to inhibit fluids entering the interior of the housing. The grommet is a one piece structure that has a side section and a lower intermediate section. The lower intermediate section includes an opening to provide access to at least a portion of a filler tube that is used to fill a fuel tank of the engine driven device. The lower intermediate section also includes a lip that extends outwardly from the housing of the engine driven device.

112 Claims, 4 Drawing Sheets

FUEL ASSEMBLY FOR AN ENGINE WELDER

BACKGROUND OF THE INVENTION

This invention pertains to engine driven welding machines, and more particularly to arrangements for filling the fuel tanks of welding machine engines.

INCORPORATION BY REFERENCE

U.S. Pat. Nos. 5,928,535; 6,172,332; 6,263,926; and 6,296,027; and the Operator's Manual for the RANGER 9 are incorporated herein by reference and illustrate various types of grommets that can be used fuel assembly arrangements for engine welders.

BACKGROUND OF THE INVENTION

Engine driven welding machines include a gas powered engine to run a generator which supplies power to the welding electrode. Consequently, the fuel tank for the gas powered engine must be periodically refilled with fuel. Years ago, the gas tank opening for the engine welder was located at or near the base of the engine welding machine. This position of the gas tank opening of the welder had several disadvantages, one which was that an operator was required to bend down to the ground to open, fill and then reseal the gas tank. This problem was solved by the RANGER 8 and 9 sold by The Lincoln Electric Company. The RANGER 8 and 9 included a cut out in the top cover of the engine welder to allow a filler tube to project therethrough. The filler tube extended to the fuel tank located in the base of the engine welder. As a result, an operator could will the fuel tank without having to bend down to the ground.

Another disadvantage of prior engine welder fuel assemblies was that the close proximity of the gas tank opening to the top of the gas tank provided little, if any, warning to the operator during fueling that the gas tank was approaching a full condition, thus resulting in fuel spillage. This problem was also solved by the RANGER 8 and 9. The fuel tank of the RANGER 8 and 9 was located at the base of the engine welder housing and the filler tube opening was located above the top cover of the engine welder housing. As a result, the longer filler tube provided additional warning time to an operator during the filling of the fuel tank. In addition, the filler tube volume was larger volume near the fuel tank than at the filler tube opening. This variable volume of the filler tube also provided the operator additional warning that the fuel tank was approaching a full condition.

Prior engine welder had the further disadvantage of allowing fuel, that back flowed through the filler tube during the filling of the fuel tank, to flow all over the top and/or side surface of the engine welder housing. Such fuel spillage could result in the defacing of the engine welder housing and/or damage to the internal components of the engine welder. Once again this problem was overcome by the RANGER 8 and 9. The RANGER 8 and 9 incorporated the use of a grommet that was positioned in the cut out opening in the top cover of the engine welder. The grommet sealed the cut out opening to prevent fuel from leaking into the interior of the engine welder housing. The grommet was also designed to direct any spilled fuel, resulting from the filling of the fuel tank, off to the side of the engine welder housing. As a result, any fuel spills were controlled by the grommet and resulting in the spilled fuel being safely directed off the side of the engine welder housing.

Although the fuel assembly design of the RANGER 8 and 9 has been commercially successful, at times, fuel spillage can occur from the filler opening during the filling of the fuel tank. During the filling of the fuel tank, back flow of the fuel from the filler tube opening periodically occurred even though the filler tube length had been extended and the filler tube had a larger volume near the fuel tank. In order to address this problem, The Lincoln Electric Company developed a new fuel tank assembly which incorporated the use of a fuel gauge. This fuel tank assembly is disclosed in U.S. Pat. Nos. 6,263,926 and 6,296,027, which are incorporated herein by reference. The fuel gauge is positioned adjacent to the filler tube and allows an operator to monitor the fuel level in the fuel tank during the filling of the fuel tank. As a result, the operator is able to terminate the filling of the fuel tank long before any back flow occurs through the filler tube. A grommet was again used to seal the cut out region about the filler tube. A portion of the top and adjacent side of the engine welder is cut out and the grommet is positioned in the cut-out region to reseal the top and side of the engine welder. The opening of the filler tube extends through the bottom of the grommet. The cavity of the grommet directs spilled fuel to one side of the engine welder for easier cleanup of spills. The grommet, like all grommets, was designed to maintain a seal between the filler tube and the grommet during the operation of the engine welder so as to prevent any fuel that spills out of the filler tube opening to enter the interior of the engine welder housing. The grommet also allowed for easy removal and cleaning during the periodic servicing of the engine welder.

Although the fueling assembly disclosed in Assignee's U.S. Pat. Nos. 6,263,926 and 6,296,027 addressed many of the past problems associated with the fueling of engine welders, there remains a need for a fuel assembly for an engine welder that minimizes the incident of splashback and spillover during the fueling of the engine welder, is easy to service, facilitates in proper sealing, and minimizes or prevents fuel from damaging the engine welder during the occurrence of a fuel spill occurs.

SUMMARY OF THE INVENTION

The present invention relates to a fueling assembly for a housed engine, and more particularly, to an improved grommet for the filler tube opening in the housing of an engine welder; however, the invention is not limited to engine welders, and can be used in all types of mechanisms that include a gas powered engine.

In accordance with a principal aspect of the present invention, an engine driven device is provided which includes a housing to at least partially protect the internal components of the engine. The engine driven device may include one or more other components at least partially in the housing. One type of engine driven device that is particularly applicable to the present invention is an engine driven welder. Typically, an engine driven welder includes a housing to protect the internal components of the welder. Protected by the housing is a fuel powered engine and an electric generator. The fuel powered engine runs the electric generator which in turn produces electricity for the arc welder. The electric generator is selected to produce electricity for various types of welders, such as, but not limited to, TIG welders, plasma arc welders, MIG welders, STT welders, and the like. Electric circuitry can be included within the housing to control the amount of current, voltage, power and/or the waveform of current directed to the electrode of the welder. A fuel tank is provided within the housing to supply fuel to the fuel powered motor. The fuel tank can be positioned in various areas within the housing, but is typically positioned at or near the base of the housing of the engine driven welder. A filler tube is connected to a portion of the fuel tank and extends upwardly from the fuel tank and through a portion of the housing to enable an operator to refill the fuel tank. The filler tube and fuel tank can be made from one or multiple pieces of material. The filler tube and fuel tank are typically made of a durable material such as, but not limited to, a plastic and/or a metal material. The engine welder typically includes a control panel to operate various internal components of the welder and to provide connectors to various components of the welder. One or more fixed or adjustable exhaust pipes for the fuel powered engine are also included on the engine driven welder. The one or more exhaust pipes can extend vertically upward or be oriented at some other angle. These and other standard components of an engine driven welder are disclosed in U.S. Pat. Nos. 5,928,535; 6,172,332; 6,263,926; and 6,296,027, which are incorporated herein by reference. The engine driven welder is typically transported by a welding carriage. One particular welding carriage which can be used is disclosed in Assignee's U.S. patent application Ser. No. 09/411,106, filed Oct. 4, 1999, which is incorporated herein by reference. In one embodiment of the invention, the filler tube and fuel tank arrangement includes a fuel gauge. The fuel gauge enables an operator to monitor fuel levels within the filler tube and/or fuel tank, enables an operator to anticipate when the engine driven welder needs to be refueled, and/or notifies an operator during the refueling process when the fuel tank is filled, thereby reducing or avoiding spillage and waste of fuel. In one aspect of this embodiment, the fuel gauge is designed to notify an operator during the refueling process of the fuel level within the fuel tank and/or filler tube, to enable an operator to cease the fueling operation prior to fuel backflowing and/or spilling out of the opening in the filler tube. The minimizing of spillage reduces the amount of potential damage to the welder and/or components about the welder, reduces the time and money required for clean-up of the spilled fuel, and/or reduces the money lost in wasted fuel. In another and/or alternative aspect of this embodiment, the fuel gauge is designed to monitor the fuel level within the fuel tank to inform an operator of the current fuel level within the fuel tank. In one particular non-limiting design, a portion of the fuel gauge extends into the fuel tank to allow for fuel level monitoring within the fuel tank. In still another and/or alternative aspect of this embodiment, the fuel gauge includes a fuel level indicator that registers at least one fuel level. In one particular non-limiting design, the fuel level indicator indicates multiple fuel levels within the fuel tank (e.g., full, empty, ¼-filled, etc). In yet another aspect of this embodiment, the fuel gauge includes a fuel level indicator and a fuel level sensor assembly, which fuel level sensor assembly at least partially extends the length of the filler tube. In one particular non-limiting design, the fuel level sensor assembly incorporates mechanical, electrical and/or chemical mechanisms to at least partially sense the fuel level in the fuel tank. In another particular non-limiting design, the fuel level sensor assembly includes a mechanical float to at least partially sense the fuel level in the fuel tank.

In accordance with another and/or alternative aspect of the present invention, a fueling cavity is positioned in a top portion of the housing of the engine driven device such as, but not limited to, an engine driven welder. The fueling cavity is designed to provide access to the filler tube opening. The fueling cavity can also be designed to provide access to a fuel level indicator of a fuel gauge, if a fuel gauge is used. In one embodiment of the invention, the base of the fueling cavity is recessed from the top portion of the housing. In another and/or alternative embodiment of the invention, a portion of the fueling cavity is recessed from at least one side portion of the housing. In still another and/or alternative embodiment of the invention, the fueling cavity is positioned on a top portion edge of the housing. In one aspect of this embodiment, the fueling cavity forms a recessed cavity in both the top and side portions of the housing. In still yet another and/or alternative embodiment of the invention, the filler tube opening extends at least to and generally to a point above the base of the fueling cavity. In one aspect of this embodiment, a portion of the filler tube extends from the interior of the housing, into the filler cavity and to a point such that the filler tube opening is level with or positioned at some point below the top portion and/or side of the housing. In another and/or alternative aspect of this embodiment, a portion of the filler tube extends from the interior of the housing, into the filler cavity and to a point such that the filler tube opening is positioned at some point above the top portion and/or extends outwardly from the side of the housing. In a further and/or alternative embodiment of the invention, the fuel level indicator of the fuel gauge is positioned at a point that is flush with, or above, the base of the fueling cavity. In accordance with one aspect of this embodiment, the fuel gauge extends upward from the interior of the housing and into the fueling cavity. In one particular non-limiting design, the fuel level indicator is positioned at or near the base of the fueling cavity. In another particular non-limiting design, the fuel level indicator is positioned level with or below the position of the filler tube opening. In yet a further and/or alternative embodiment of the invention, the fuel level indicator is positioned in the fueling cavity such that the fuel level indicator is positioned closer to a side portion of the housing than the filler tube opening. In one aspect of this embodiment, the fuel level indicator is spaced from the side portion of the housing.

In accordance with still another and/or alternative aspect of the present invention, the filler tube has a cross-sectional area along the length of the filler tube to accommodate a fuel gauge positioned at least partially within the filler tube. The filler tube includes a top portion and a bottom portion. The bottom portion can be uniformly formed with the fuel tank or sealed to the fuel tank by various means such as, but not limited to, welding, bolting, adhesives, and/or the like. The cross-sectional area of the filler tube is sufficiently large to accommodate a fuel level sensor assembly that is at least partially positioned within the interior of the filler tube. The fuel level sensor assembly can be designed to partially extend or fully extend through the length of the filler tube. The fuel level sensor assembly can be designed to measure the fuel level within the fuel tank and/or filler tube by a mechanical, chemical and/or electrical sensing arrangement. In one embodiment of the invention, the top portion of the filler tube is designed to accommodate both the filler tube opening and a portion of a fuel gauge of the fuel level sensor assembly. In one aspect of this embodiment, the cross-sectional area of the filler tube does not substantially increase from the neck of the filler tube opening to the point where the fuel gauge is positioned within the filler tube. In another and/or alternative embodiment of the invention, the filler tube opening includes a removable cap to enable an operator to open and close the filler tube opening. In one aspect of this embodiment, the cap allows fumes to escape through the cap when the pressure within the filler tube exceeds a predetermined pressure. This design of the cap helps to inhibit or prevent high pressures from building up within the filler tube and/or fuel tank. In another and/or alternative aspect of this embodiment, the top of the cap, when the cap is inserted on the filler tube opening, is level with or above the housing surface. In still another and/or alternative embodiment of the invention, the filler tube is configured to bypass the components inside the housing of the engine driven device.

In accordance with yet another and/or alternative aspect of the present invention, a grommet is provided to be at least partially inserted in the fueling cavity of the housing of the engine driven device. In one embodiment of the invention, the grommet is designed to at least partially seal the region about the fueling cavity to inhibit and/or prevent fluids from entering the interior of the housing of the engine driven device. In another and/or alternative embodiment of the invention, the grommet defines at least one portion of the fueling cavity. In one aspect of this embodiment, a portion of the housing is cut out and the grommet is inserted into this cut-out portion of the housing. In this arrangement, the edges of the cut-out housing and at least a portion of the grommet define the fueling cavity. In still another and/or alternative embodiment of the invention, the grommet includes a side section and a lower intermediate section. In one aspect of this embodiment, the side section is formed into an arcuate shape. One non-limiting arcuate shape is a generally U-shaped configuration. In another and/or alternative aspect of this embodiment, the side section includes an arcuate base portion. In one non-limiting design, the arcuate base portion forms a sloping transition between the side section and lower intermediate section of the grommet. In still another and/or alternative aspect of this embodiment, the lower intermediate section of the grommet includes a curved portion which has a radius of curves similar to the radius of curvature of the base portion of the side section, so as to form a substantially uniform sloped surface between a portion of the surfaces between the side section and lower intermediate section of the grommet. In one non-limiting design, the lower intermediate section of the grommet includes a curved portion which has a radius of curves similar to the radius of curvature of the base portion of the side section, so as to form a substantially uniform sloped surface between substantially all of the surfaces between the side section and lower intermediate section of the grommet. In yet another and/or alternative aspect of this embodiment, the lower intermediate section and a portion of the side section of the grommet form an arcuate shape such as, but not limited to, a generally U-shaped configuration. As can be appreciated, the side section and/or lower intermediate section can have a variety of other shapes so as to accommodate the shape of the fueling cavity. In still yet another and/or alternative embodiment, the grommet is a one-piece structure. In one aspect of this embodiment, the grommet is molded so that the lower intermediate section and the side section have no seams. In one non-limiting example, the lower intermediate section and the side section of the grommet are formed together during the formation of the grommet such that the lower intermediate section and the side section do not have to be subsequently connected together by heat, adhesives, and/or the like.

In accordance with still yet another and/or alternative aspect of the present invention, the grommet is made up of one or more materials to satisfy the durability needs and versatility needs of the grommet. In one embodiment of the invention, the grommet is made of a material that is flexible and resists degradation by petroleum products. In one aspect of this embodiment, the grommet includes, but is not limited to, rubber, plastic and/or various types of composite materials. In another and/or alternative aspect of this embodiment, the side section and lower intermediate portion of the grommet are made of substantially the same material. In still another and/or alternative aspect of this embodiment, the side section and lower intermediate portion of the grommet are made of a single material. In yet another and/or alternative aspect of this embodiment, the side section and lower intermediate portion of the grommet are made of a different material.

In accordance with a further and/or alternative aspect of the present invention, the lower intermediate section of the grommet includes an opening which provides access to at least a portion of the filler tube. In one embodiment of the invention, the filler tube opening extends at least to the opening in the lower intermediate section of the grommet. In one aspect of this embodiment, the filler tube opening extends above the opening in the lower intermediate section of the grommet. In another and/or alternative aspect of this embodiment, the lower intermediate section includes an opening of sufficient size to provide access to at least a portion of the filler tube opening and at least a portion of the fuel gauge to enable an operator at least partial access to at least a portion of the filler tube opening and at least a portion of the fuel gauge. In another and/or alternative embodiment, the opening in the lower intermediate section of the grommet is positioned such that at least a portion of the side of the opening is spaced a distance from at least a portion of the side section of the grommet. In one aspect of this embodiment, the opening in the lower intermediate section of the grommet is fully spaced from the side section of the grommet. In another and/or alternative aspect of this embodiment, the opening in the lower intermediate section of the grommet is equally spaced from a majority of the base portion of the side section of the grommet. In one non-limiting design, the opening in the lower intermediate section of the grommet is equally spaced from at least 60 percent of the base portion of the side section of the grommet. In still another and/or alternative embodiment of the invention, the opening in the lower intermediate section of the grommet has a non-circular shape. In one aspect of this embodiment, the opening in the lower intermediate section of the grommet has a substantially oval shape. In another and/or alternative aspect of this embodiment, the opening in the lower intermediate section of the grommet has a substantially cone shape. As can be appreciated, other non-circular shapes can be used.

In accordance with still a further and/or alternative aspect of the present invention, the grommet includes an outwardly extending flange which is connected to at least a portion of the edge of the side section of the grommet. The flange is designed to at least partially form a seal at least partially about the perimeter of the fueling cavity to inhibit or prevent fluids from inadvertently entering the interior of the housing of the engine welder. In one embodiment of the invention, the flange is connected to at least a majority of the edge of the side section of the grommet. In another and/or alternative embodiment of the invention, the flange extends outwardly from the edge of the side section to form an angle between the flange and the side section of about 60–120°. In one aspect of this embodiment, the angle between the flange and the side section is about 70–95°. In still another and/or alternative embodiment of the invention, the flange includes one or more apertures to secure the flange to the housing of the engine welder. In one aspect of this embodiment, the flange includes a plurality of apertures. In another and/or alternative aspect of this embodiment, a plurality of apertures are spaced apart from one another at substantially equal distances. In one non-limiting design, at least three apertures are spaced apart from one another at substantially equal distances. In another non-limiting design, at least four apertures are spaced apart from one another at substantially equal distances. In still another and/or alternative aspect of this embodiment, a plurality of apertures are adapted for use to connect the grommet to the top portion of the housing of the engine driven welder and a plurality of apertures are adapted for use to connect the grommet to the side portion of the housing of the engine driven welder. In yet another and/or alternative embodiment of the invention, the flange is at least partially secured to the top surface of the engine welder housing. In still yet another and/or alternative embodiment of the invention, the flange is at least partially secured to the underside surface of the engine welder housing. In a further and/or alternative embodiment of the invention, a portion of the flange is secured to the upper surface of the housing and a portion of the flange is secured to the underside of the housing. In still a further and/or alternative embodiment of the invention, a connection arrangement such as, but not limited to, screws, bolts, clips, adhesives, tongue and groove arrangements, snaps and/or slots or similar arrangements are used to at least partially secure the flange to the engine welder housing. In yet a further and/or alternative embodiment of the invention, the flange is not connected to the lower intermediate section of the grommet.

In accordance with yet a further and/or alternative aspect of the present invention, the grommet includes a sealing structure which is positioned in the opening of the lower intermediate section of the grommet. The sealing structure is designed to at least partially form a seal about a portion of the filler tube that is positioned even with or above the opening in the lower intermediate section of the grommet. When a fuel gauge is used, the sealing structure can be designed to also form a seal at least about a portion of the fuel gauge that is positioned even with or above the opening in the lower intermediate section of the grommet. The sealing structure is designed to at least partially inhibit or prevent fluids, which spill from the filler tube or are spilled onto the grommet during refueling, from seeping through the opening in the lower intermediate section of the grommet. In one embodiment of the invention, the sealing structure includes a flexible flap. The flexible flap is designed to at least partially engage at least a portion of the filler tube and/or fuel gauge when the grommet is positioned in the fueling cavity. In one aspect of this embodiment, the flexible flap slopes upwardly from the opening in the lower intermediate section of the grommet. The upward slope exists prior to the grommet being inserted in the fueling cavity. This upward sloping arrangement of the flexible flap facilitates in ensuring that a proper seal is formed at least about a portion of the filler tube and/or fuel gauge when the grommet is inserted into the fueling cavity. In one non-limiting design, the flexible flap has an angle of slope of about 5–50°. This angle may or may not increase when the flexible flap is inserted at least about a portion of the filler tube and/or fuel gauge. In another and/or alternative aspect of this embodiment, the thickness of at least a portion of the flexible flap is variable. In one non-limiting design, at least a part of the portion of the flexible flap that is designed to engage the filler tube and/or fuel gauge is thinner than other portions of the flexible flap. In another non-limiting design, the portion of the flexible flap that is designed to engage the filler tube and/or fuel gauge is thinner than other portions of the flexible flap. Such variable thickness facilitates in the flexibility of the flexible flap when being inserted at least about a portion of the filler tube and/or fuel gauge. In another and/or alternative embodiment of the invention, at least a portion of the opening in the sealing structure is the same or smaller than the portion of the filler tube and/or fuel gauge which is to be at least partially surrounded by the sealing structure. This smaller opening causes at least a portion of the sealing structure to at least partially stretch and/or bend about at least a portion of the surface of the filler tube and/or fuel gauge to form a substantially tight fit and seal. In one aspect of this embodiment, when the sealing structure includes a flexible flap, the opening through the flexible flap is smaller than at least a portion of the filler tube and/or fuel gauge that engages the flap. The smaller opening causes the flap to at least partially stretch and/or bend about at least a portion of the surface of the filler tube and/or fuel gauge to form a substantially tight fit and seal. In still another and/or alternative embodiment of the invention, the sealing structure includes a filler cavity which extends downwardly and/or upwardly from the opening in the lower intermediate section of the grommet. The filler cavity is designed to at least partially surround a portion of the filler tube and/or fuel gauge when the grommet is positioned in the fueling cavity. In one embodiment of the invention, the cavity wall of the filler cavity forms a cavity designed to be at least partially inserted about a portion of the top portion of the filler tube and/or fuel gauge. In one aspect of this embodiment, the size and shape of the filler cavity closely matches the size and shape of a portion of the filler tube and/or fuel gauge so as to closely fit with the portion of the filler tube and/or fuel gauge. The size and/or shape of the filler cavity facilitates in ensuring that the grommet is properly positioned about the top portion of the filler tube and/or fuel gauge, and/or properly positioned in the fueling cavity. The filler cavity also facilitates in inhibiting or preventing the movement of the grommet within the fueling cavity, and/or about the filler tube and/or fuel gauge, which movement could result in the quality of the seal being reduced or compromised during operation of the engine driven device. In one non-limiting design, the cavity wall of the filler cavity is designed to at least partially contact a portion of the filler tube and/or fuel gauge to thereby form a secure fit and/or seal between the cavity wall and the filler tube and/or fuel gauge. The secure fit and/or seal formed between the cavity wall and the filler tube and/or fuel gauge facilitates in inhibiting or preventing fluids from entering the interior of the housing of the engine drive device. In another non-limiting design, the cavity wall of the filler cavity is designed to be spaced from the filler tube and/or fuel gauge so that the cavity wall can be easily positioned about the filler tube and/or fuel gauge. In another and/or alternative aspect of this embodiment, at least a portion of the cavity wall extends about the opening in the lower intermediate section of the grommet. In one non-limiting design, the cavity wall fully extends about the opening in the lower intermediate section of the grommet. In still another and/or alternative aspect of this embodiment, the cavity wall extends below the opening in the lower intermediate section of the grommet. In yet another and/or alternative aspect of this embodiment, the cavity wall extends above the opening in the lower intermediate section of the grommet. In still yet another and/or alternative aspect of this embodiment, the cavity wall is connected to at least a portion of the flexible flap. In one non-limiting design, at least a portion of the flexible flap is connected to the cavity wall that is positioned above the lower intermediate section of the grommet. In this design, at least a portion of the flexible flap is spaced above the lower intermediate section of the grommet. In a further and/or alternative aspect of this embodiment, the cavity wall includes at least one support rib to increase the rigidity of the cavity wall. In one non-limiting design, a plurality of support ribs are positioned about the cavity wall. In another and/or alternative non-limiting design, at least one support rib extends the complete vertical length of the cavity wall that extends downward from the opening in the lower intermediate section of the grommet. In still another and/or alternative non-limiting design, at least one support rib extends the complete vertical length of the cavity wall that extends upwardly from the opening in the lower intermediate section of the grommet.

In accordance with still yet another and/or alternative aspect of the present invention, the grommet includes at least one positioning stub on the bottom surface of the lower intermediate section. The positioning stub is designed to be inserted into a hole in the housing of the engine driven device. The positioning stub is designed to at least partially ensure that the grommet is properly positioned in the fueling cavity. The positioning stub also facilities in reducing movement of the grommet within the fueling cavity which could compromise the sealing of the grommet in the fueling cavity. In one embodiment of the invention, the housing of the engine driven welder includes a housing positioning flange which extends inwardly from the housing of the engine driven device. The housing positioning flange includes one or more holes to at least partially receive the positioning stub. In another and/or alternative embodiment of the invention, at least one positioning stub is positioned at least closely adjacent to the front edge of the lower intermediate section. In one aspect of this embodiment, at least one positioning stub is spaced from the front edge of the lower intermediate section. In another and/or alternative aspect of this embodiment, the positioning stub includes at least one groove and/or rib that is at least partially designed to inhibit or prevent the stub from inadvertently releasing from the hole in the housing.

In accordance with a further and/or alternative aspect of the present invention, the grommet includes a lip that extends outwardly from the lower intermediate section of the grommet. The lip is designed to at least partially direct fuel or other liquids away from the side of the engine driven device. As such, the lip reduces the amount of liquid that travels down the side of the housing of the engine driven device after exiting the grommet. In one embodiment of the invention, the lip extends outwardly from the side of the housing of the engine driven device when positioned in the fueling cavity. In one aspect of this embodiment, the lip extends outwardly from the side of the housing of the engine driven device at about 0.0625–3 inches when positioned in the fueling cavity. As can be appreciated, the lip can extend outwardly from the side of the housing a length greater than 3 inches. In one non-limiting design, the lip extends at least about 0.5 inch from the side of the housing. In another and/or alternative embodiment, the lip has substantially the same top profile as the lower intermediate section of the grommet. As such, the lip is an extension of the lower intermediate section of the grommet. In still another and/or alternative embodiment, the lip has a different top profile from the lower intermediate section of the grommet. In yet another and/or alternative embodiment, the lip has substantially the same thickness as the lower intermediate section of the grommet. In still yet another and/or alternative embodiment, the lip has a different thickness than the lower intermediate section of the grommet. In a further and/or alternative embodiment, the lip lies in substantially the same plane as the lower intermediate section of the grommet. In still a further and/or alternative embodiment, the lip lies in a different plane than the lower intermediate section of the grommet. In yet a further and/or alternative embodiment, the lip has substantially the same width as the lower intermediate section of the grommet. In still yet a further and/or alternative embodiment, the lip has a different width than the lower intermediate section of the grommet. In another and/or alternative embodiment, the lip is made of substantially the same material as the lower intermediate section of the grommet. In still another and/or alternative embodiment, the lip is made of a different material than the lower intermediate section of the grommet.

In accordance with still a further and/or alternative aspect of the present invention, the top surface of the lower intermediate section of the grommet slopes downwardly. The downward slope of the lower intermediate section facilitates in causing fluids which spill into the grommet to flow out of the grommet, so as to reduce the amount of stagnate fluid in the grommet. In one embodiment of the invention, the angle of slope is about 1–20°. In another and/or alternative embodiment of the invention, when a lip is positioned at the end of the lower intermediate section, the lip maintains the slope of the lower intermediate section. In one aspect of this embodiment, the lip lies in the same plane as the lower intermediate section. In still another and/or alternative embodiment of the invention, the top surface of the lower intermediate section of the grommet slopes downwardly from the rear to the front of the lower intermediate section. In yet another and/or alternative embodiment of the invention, the top surface of the lower intermediate section of the grommet slopes downwardly from a point spaced from the rear to the front of the lower intermediate section.

The principal object of the present invention is to provide a fueling assembly which minimizes the incidents of splash-back and spillover during fueling.

Another and/or alternative object of the present invention is to provide a fueling assembly which is easy to service and install.

Yet another and/or alternative object of the present invention is to provide a fueling assembly which has proper sealing, and which minimizes or prevents fluids from contaminating the interior of the engine driven device when a fuel spill occurs.

Still another and/or alternative object of the present invention is to provide a fueling assembly which minimizes damage to the fueling assembly components during the operation of the engine driven device.

Still yet another and/or alternative object of the present invention is to provide a fueling assembly which includes a fuel gauge to monitor fuel levels to thereby reduce or prevent spillage.

A further and/or alternative object of the present invention is to provide a fueling assembly which includes a fuel gauge having a fuel indicator that registers a plurality of fuel levels within the fuel tank of the fuel assembly.

Another and/or alternative object of the present invention is to provide a fuel assembly which includes a grommet that forms a fluid seal in a fueling cavity of an engine driven device.

Yet another and/or alternative object of the present invention is to provide a fuel assembly which includes a one-piece grommet that can be connected to the top and/or bottom of the housing of the engine driven device.

Still another and/or alternative object of the present invention is to provide a fuel assembly which includes a grommet having a flexible flap which forms a seal with components of the fueling assembly that protrude through the lower intermediate section of the grommet.

Still yet another and/or alternative object of the present invention is to provide a fueling assembly which includes a grommet having a filler cavity that engages a top portion of a filler tube to maintain the position of the grommet about the filler tube and/or to form a seal between the grommet and the filler tube.

A further and/or alternative object of the present invention is to provide a grommet having reinforcement ribs positioned on the walls of the filler cavity to provide rigidity and/or structural support to the cavity walls of the filler cavity.

Still a further and/or alternative object of the present invention is to provide a grommet having a lower intermediate section which downwardly slopes toward the side of the housing of the engine driven device when the grommet is positioned and secured in the engine driven device.

Another and/or alternative object of the present invention is to provide a fueling assembly which includes a grommet having a positioning stub to position a portion of the grommet in the fueling cavity and/or to maintain in position the grommet in the fueling cavity.

Still another and/or alternative object of the present invention is to provide a fueling assembly which includes a grommet that directs fluid away from the side of an engine driven device.

Yet another and/or alternative object of the present invention is to provide a fueling assembly which includes a grommet having a lip that extends outwardly from the housing of the engine drive device.

Still yet another and/or alternative object of the present invention is to provide a fueling assembly which includes a grommet having a sloped lower intermediate section.

These and other objects and advantages of the invention will become apparent to those skilled in the art upon reading and following this description taken together with the accompanying drawings.

BRIEF DESCRIPTION OF THE DRAWINGS

Reference may now be made to the drawings which illustrate various embodiments that the invention may take in physical form and certain parts and arrangements of parts wherein.

DETAILED DESCRIPTION OF THE EMBODIMENTS

Figure 1:
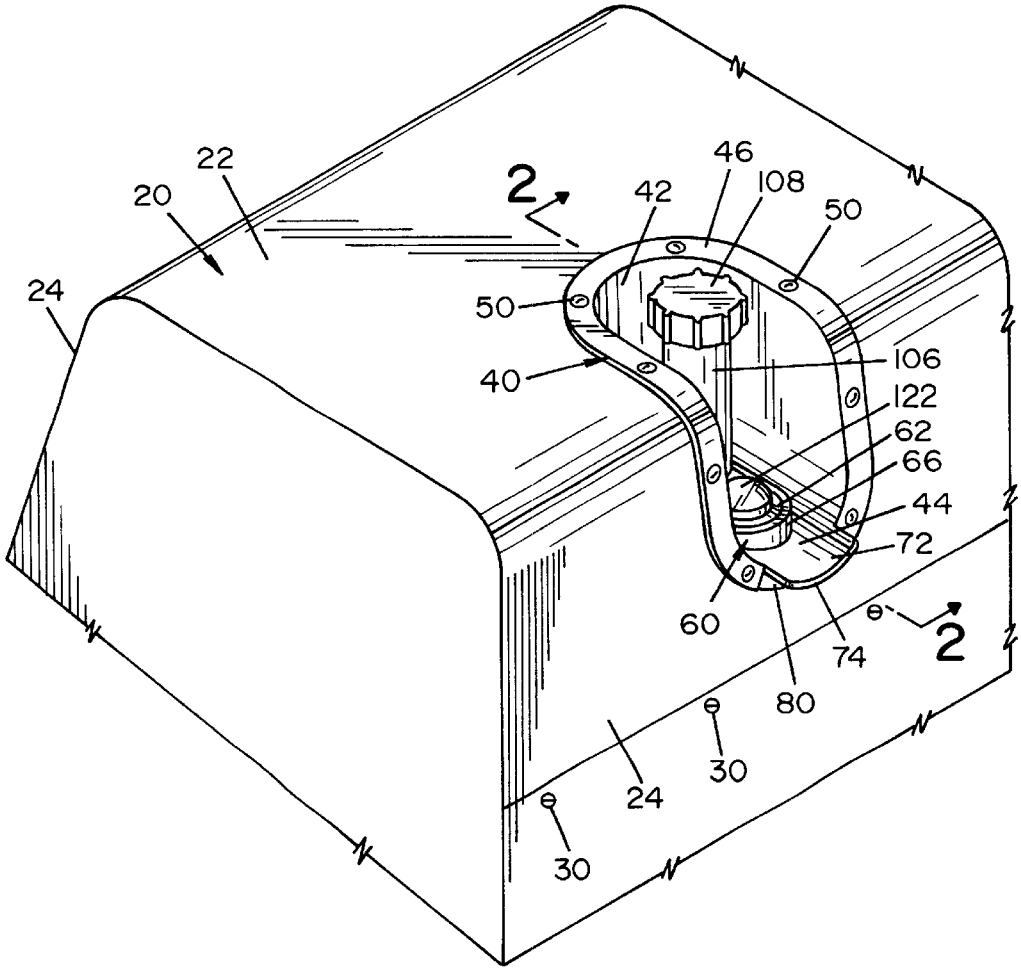
FIG. 1 is a perspective view of the housing of an engine welder showing the grommet in accordance with the present invention secured in the fueling cavity of the housing.

Referring now to the drawings, wherein the showings are for the purposes of illustrating the preferred embodiments of the invention only and not for the purpose of limiting the same, FIG. 1 illustrates a portion of a housing 20 which is secured to a typical engine welder or other engine driven device, not shown. Housing 20 includes a top portion 22 and two side portions 24. The housing is designed to encase at least a portion of the internal components of the engine welder or other engine driven device. Typically positioned in top portion 22 of the housing is an exhaust pipe opening, not shown, and a motor access opening, not shown. Several bolts 30 are positioned about the housing to enable the welding housing to be secured to the frame of the engine welder or other engine driven device. The configuration of the exhaust pipe opening and motor access opening are well known in the art and are disclosed in U.S. Pat. Nos. 5,928,535; 6,172,332; 6,263,926; and 6,296,027, which are incorporated herein by reference.

Positioned in the top and side portion of the housing 20 is a grommet 40. Grommet 40 is positioned in the fueling cavity 36 of the housing 20. Fueling cavity 36 is formed by a cut-out section of the top section and side portion of the housing. As shown in FIG. 1, grommet 40 is inserted into fueling cavity 36 and seals the fueling cavity to inhibit or prevent fluids from entering the interior of the housing.

Referring now to FIGS. 1–5, grommet 40 is a one-piece structure made of a flexible material such as rubber. As can be appreciated, the grommet can be a multi-piece structure that is connected together by various means (e.g. heat, adhesive, etc.). Grommet 40 includes a side section 42 and a lower intermediate section 44. Connected to the edge of side section 42 is a side flange 46 which extends outwardly from side section 42. Several flange apertures 48 are positioned on flange 46 to enable grommet 40 to be secured to welding housing 20 by bolts 50. Side section 42 is generally U-shaped and has a substantially linear upper portion and a curved base portion. As shown in FIGS. 1–4, the flange is connected to the upper surface of housing 20.

Lower intermediate section 44 is shown to have a curved portion which has a radius of curvature that is substantially the same as the radius of curvature of the base portion of the side section of the grommet 40. Positioned in the lower intermediate section is an opening 52. Opening 52 allows various components of the fueling arrangement of the engine welder or other engine driven device to be inserted therethrough.

Figure 5:
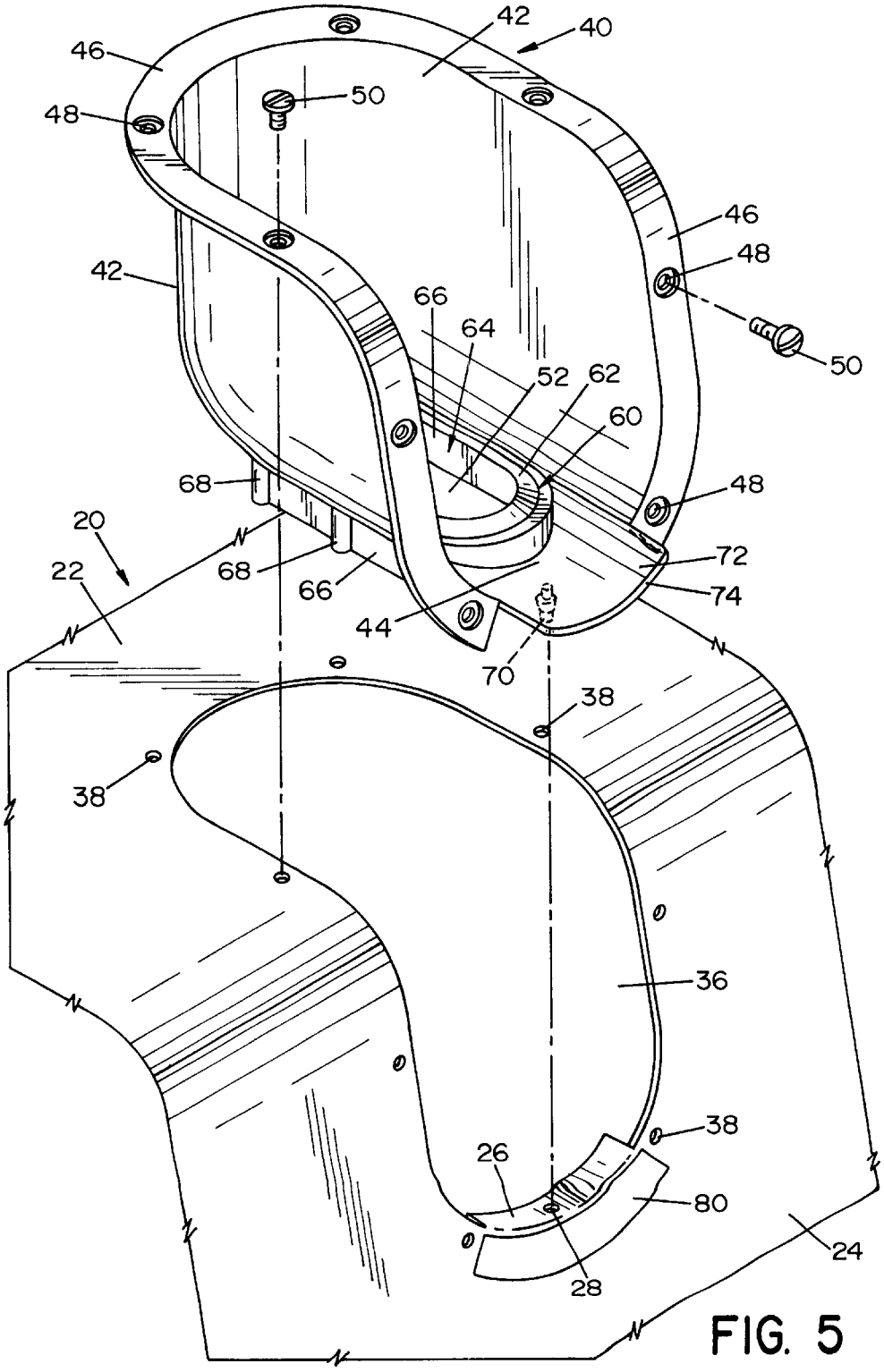

Positioned in opening 52 is a sealing structure 60. Sealing structure 60 includes a flexible seal flap 62 and a cavity wall 66 which extends downwardly from the base of the seal flap and through opening 52 to form a seal cavity 64. Seal cavity 64 at least partially extends to a point below the bottom surface of lower intermediate section 44. Cavity wall 66 is also shown to extend at least partially above opening 52. Positioned on the outer surface of cavity wall 66 which extends downwardly from the posterior side of the lower intermediate section 44 are several ribs 68 as illustrated in FIG. 5. These ribs extend from the bottom surface of lower intermediate section 44 to the bottom of cavity wall 66. The ribs provide structural support and rigidity to cavity wall 66. As can be appreciated, ribs can be positioned on cavity wall 66 that extends upwardly from opening 52. Typically, the thickness of cavity wall 66 is greater than the thickness of seal flap 62 resulting in seal flap 62 having a greater flexibility than cavity wall 66; however, this is not required.

Figure 2:
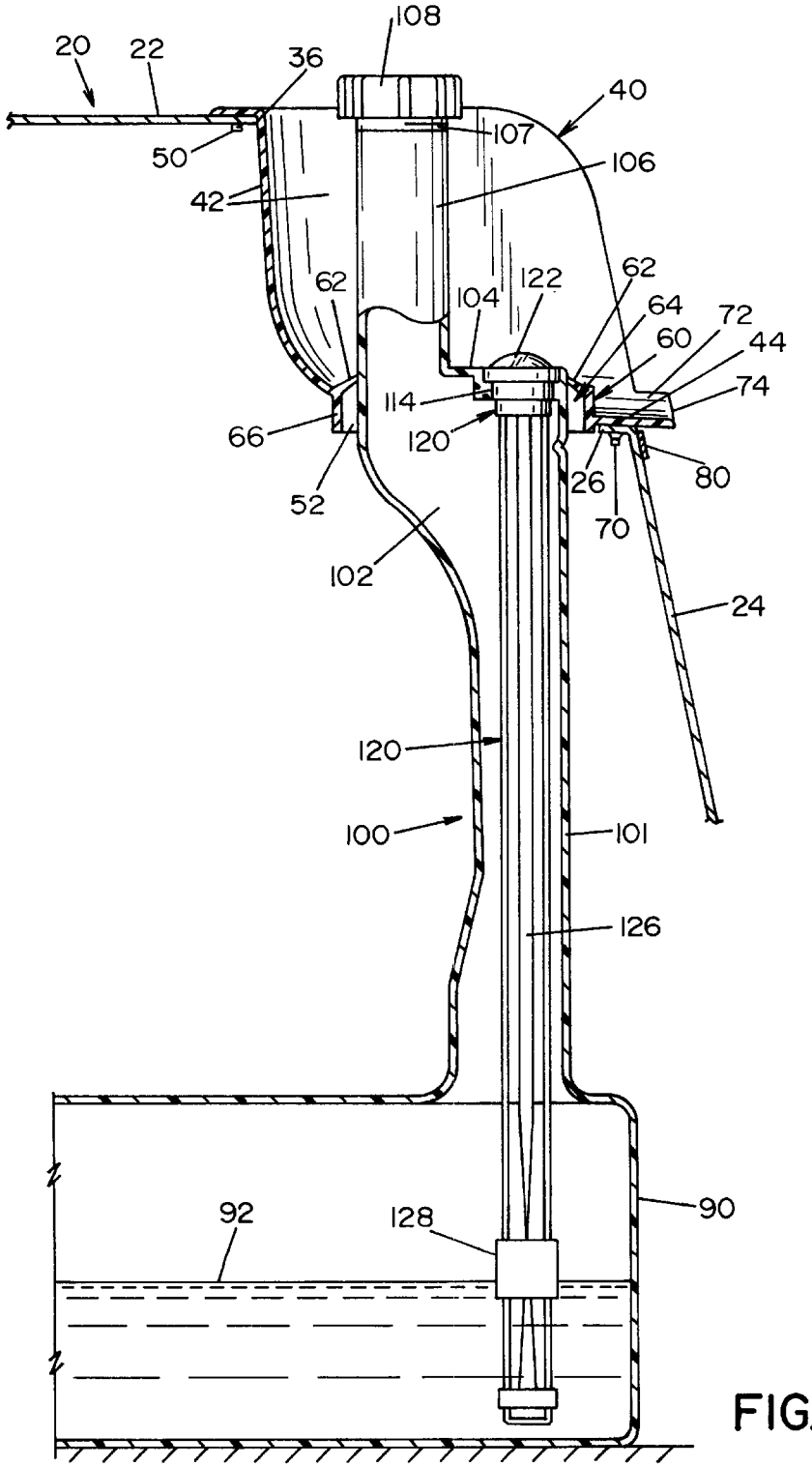
FIG. 2 is a cross-sectional view taken along line 2—2 of FIG. 1.
Figure 3:
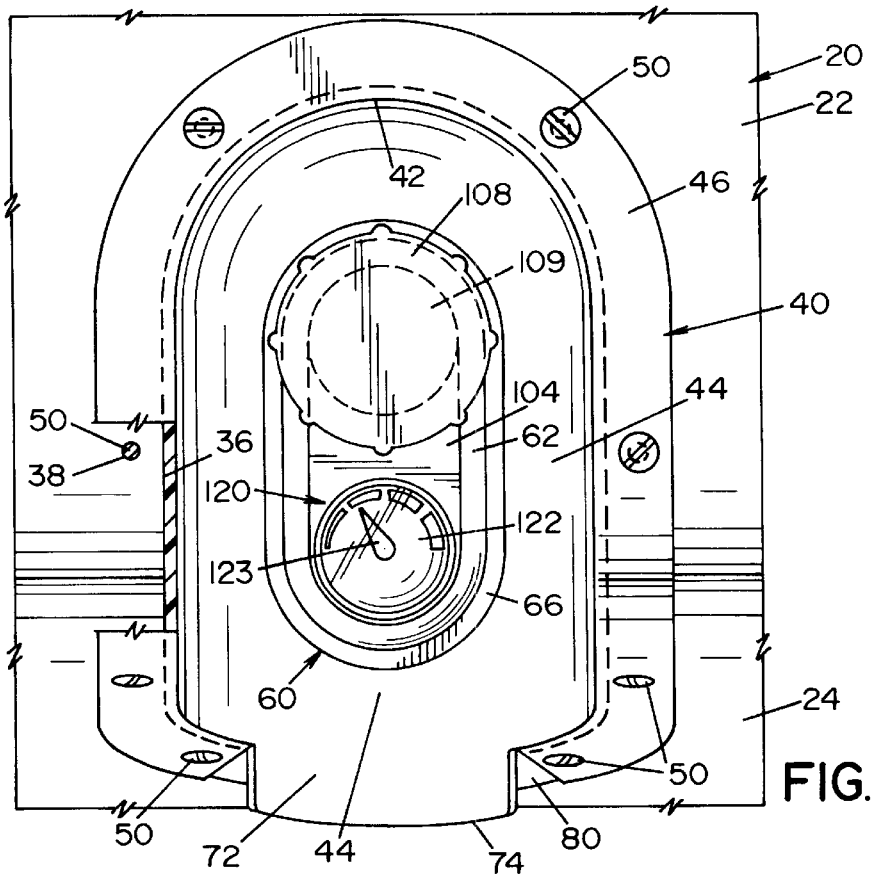
FIG. 3 is an enlarged plan view of the grommet mounted in the fueling cavity as illustrated in FIG. 1.

Referring now to FIG. 2, a stub 70 extends downwardly from the bottom surface of lower intermediate section 44. Stub 70 is designed to be positioned in a flange hole 28 of flange 26, which flange extends inwardly from side portion 24 of housing 20. Stub 70 includes a lock ledge, not shown, to secure stub 70 in the flange hole. The lock ledge can be designed to releasably secure the stub in hole 28 when the grommet needs to be removed.

As set forth above, flange 46 includes a plurality of flange apertures 48 which are used to secure grommet 40 to housing 20. As shown in FIGS. 1–4, flange 46 is positioned on the top surface of top portion 22 and the top surface of side portion 24 of housing 20 when grommet 40 is secured to the housing. Bolts 50 are inserted through flange apertures 48 and into grommet holes 38 in housing 20, thereby securing the grommet 40 to the housing. The flange 46, when secured to housing 20, forms a seal about the edge of the fueling cavity 36 to inhibit or prevent fluids from seeping past the fueling cavity edge and into the interior of housing 20. Stub 70, which is secured into flange hole 28, facilitates in ensuring that the front edge of lower intermediate section 44 is secured to the bottom edge of the fueling cavity 36 to form a proper seal to inhibit or prevent fluids from entering the interior of housing 20. Stub 70 functions as a positioning stub, facilitating in the proper positioning of the grommet 40 in fueling cavity 36.

Figure 4:
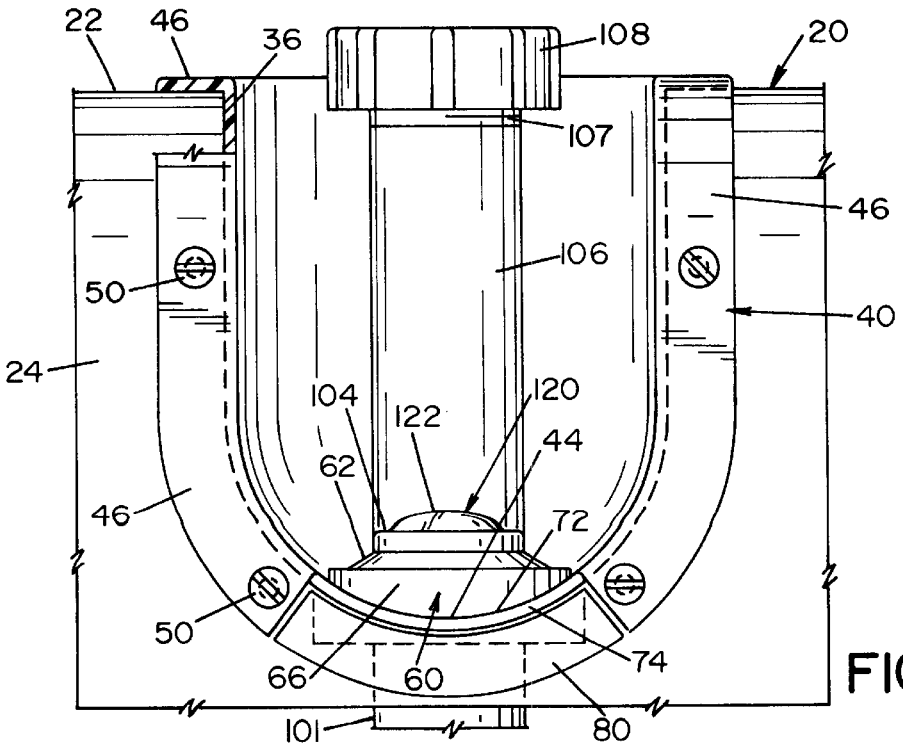
FIG. 4 is an enlarged front end elevation view of the grommet mounted in the fueling cavity as illustrated in FIG. 1; and, FIG. 5 is an exploded perspective view of the grommet and the fueling cavity in the housing of the engine welder of FIG. 1.

As best shown in FIG. 4, lower intermediate section 44 does not include a flange. The absence of the flange enables a manufacturer to insert an instruction label or informative label 80 closely adjacent to the fueling cavity 36. Label 80 has a similar shape to the bottom edge of fueling cavity 36. The shape is purely for aesthetic purposes and the label can have any desired shape. As can be appreciated, lower intermediate section 44 can be designed to include a flange.

Grommet 40 is also illustrated as including a lip 72. Lip 72 is formed at the end of lower intermediate section 44 and extends outwardly from side portion 24 of housing 20. The lip has the same surface profile as lower intermediate section 44 and lies in the same plane as lower intermediate section 44. The lip is designed to direct fluids that have spilled into the grommet to flow outwardly from side portion 24 of housing 20. As such, the lip reduces the amount of or prevents liquid from flowing from the grommet onto side portion 24 of housing 20. Although the lip is shown as extending from the lower intermediate section, the lip can also be designed to extend from a portion of side section 42.

When grommet 40 is secured in fueling cavity 36, lower intermediate section 44 slopes downwardly toward side portion 24 of housing 20 and lip 72. The sloped surface causes fluids which spill into the grommet to flow out of the grommet via the lower intermediate section and lip and over the front edge 74 of the lip and outwardly from the outer surface of side portion 24 of housing 20. The sloped surface facilitates in removing fluids from the grommet and in directing spills to a single, controlled location. The sloped surface also causes the flowing liquid to accelerate as the liquid approaches the front edge of the lip. The faster the liquid is moving as the liquid spills over the front edge of lip 72, the farther the liquid is projected from the outer surface of side portion 24 of housing 20.

Referring now to FIG. 2, a fuel tank 90 is positioned and secured into the base of the engine welder or engine driven device. Fuel tank 90 supplies fuel to the fuel powered motor, not shown, in the engine welder or engine driven device. Formed on the top portion of fuel tank 90 is a filler tube 100 which extends upwardly from fuel tank 90 and to fueling cavity 36 in housing 20. Filler tube 100 includes side walls 101. The side walls 101 are formed in such a manner to be positioned about the internal components within the engine welder or engine driven device. Filler tube 100 and fuel tank 90 are shown to be made of a one-piece material; however, filler tube 100 can be connected to the fuel tank in other arrangements. Top portion 102 of filler tube 100 includes a top landing 104. Positioned in flat top landing 104 is an opening extension 106 which extends upwardly from top landing 104 and terminates in filler opening 109. Secured to the filler opening is a opening cap 108 which is secured to the top of the filler opening by threads 107. Opening cap 108 is removed when fuel is to be added to fuel tank 90 and resealed onto the filler opening once fueling has been completed. Top landing 104 also includes a gauge opening 114 which is designed to receive and secure a portion of the fuel gauge 120. Fuel gauge 120 includes a level indicator 122 which extends upwardly from top landing 104 and a gauge sensor 126 which is secured to the base of fuel level indicator 122 and extends downwardly through filler tube 100 and into fuel tank 90. Connected near the base of gauge sensor 126 is a fuel level float 128. Float 128 is designed to float in fuel 92 within tank 90, and the positioning of float 128 on gauge sensor 126 provides fuel level information which is indicated by pointer 123 in level indicator 122. During a fueling operation, an operator is able to monitor the fuel level indicator on fuel gauge 120 to determine when fuel tank 90 is filled. Once the level indicator 122 indicates that fuel tank 90 is filled, the operator ceases the fueling operation to prevent fuel from filling the filler tube and spilling out from the filler opening 109. Fuel level indicator 122 also provides the operator with information on the amount of fuel left in fuel tank 90, to provide the operator with information to determine whether a particular operation should be started and completed prior to the fuel in the fuel tank being exhausted. If an operator determines that the operation will take more time than the amount of fuel in the fuel tank can provide to run the engine, the operator can re-fill the fuel tank prior to operation so that the operation does not have to be prematurely terminated and restarted due to the engine running out of fuel.

As illustrated in FIG. 2, top portion 102 of filler tube 100 extends through cavity wall 66 and through opening 52. Cavity wall 66 can be sized and shaped to form a seal with the top portion of filler tube 100. As shown in FIG. 2, seal flap 62 engages a portion of the top portion of filler tube 100 to form a seal between top portion 102 and grommet 40 to inhibit or prevent fluids from flowing through opening 52 in lower intermediate section 44 of grommet 40. When grommet 40 is inserted into fueling cavity 36, seal cavity 64 is positioned about top portion 102 of filler tube 100. The shape and size of seal cavity 64 is about the same size and shape as, or greater in shape and size than, top portion 102 so that a seal and/or at least semi-stable connection is formed between sealing structure 60 and top portion 102 of filler tube 100. The side of top portion 102 is designed to engage the underside surface of flexible seal flap 62 to cause the seal flap to deflect slightly upwardly to ensure that a tight seal is formed between the bottom surface of seal 62 and top portion 102. Once the side flange 46 is secured to welding housing 20, grommet 40 is secured into position to maintain the seal between the edge of fueling cavity 36 and top portion 102 of filler tube 100 and opening 52 in lower intermediate section 44 of grommet 40.

As shown in FIG. 2, the top of fuel gauge 120 is positioned inwardly from side portion 24 and below the top surface of top portion 22. In addition, opening extension 106 and opening cap 108 are also positioned inwardly from side portion 24 and slightly above the top surface of top portion 22. This positioning of the fuel gauge and opening extension and opening cap reduces damage to such components and helps to ensure that the majority of spillage from fuel exiting opening 109 is contained in grommet 40. As can be appreciated, opening extension 106 and opening cap 108 can be positioned below the top surface of top portion 22. Opening extension 106 is spaced farther from side portion 24 than fuel gauge 120. This positioning also facilitates in ensuring that the majority of spillage is contained within the grommet. However, the position of the fuel gauge and opening extension can be reversed or positioned equally from side portion 24. As illustrated in FIG. 2, the volume of top portion 102 is such that the volume of the top portion is not substantially greater that the volume of extension opening 106 and the remainder of the filler tube below the top portion, thus does not function as an expansion cavity. The use of an expansion cavity is unnecessary in due to the use of the gauge.

The invention has been described with reference to a preferred embodiment and alternatives thereof. It is believed that many modifications and alterations to the embodiments disclosed readily suggest themselves to those skilled in the art upon reading and understanding the detailed description of the invention. It is intended to include all such modifications and alterations in so far as they come within the scope of the present invention.

I claim:

1. A fueling assembly for a fuel tank of an engine driven welder, said engine driven welder including a housing having a top portion, at least one side portion, a fueling cavity in said housing, an engine and a fuel tank which supplies fuel to the engine, and a grommet positioned in said fueling cavity; said fueling assembly including a filler tube and a fuel level sensor assembly, said filler tube including a top portion extending into said fueling cavity, at least a portion of said fuel level sensor assembly extending into fueling housing, said grommet at least partially sealing said fueling cavity to inhibit fluids entering an interior of said housing, said grommet having a side section and a lower intermediate section, said lower intermediate section including an opening to provide access to at least a portion of said filler tube, said lower intermediate section having a front edge that is connected to a, at least a majority of said front edge of said lower intermediate portion connected to said lip, said lip extending outwardly at least about 0.0625 inch from said front edge of said lower intermediate portion.

2. The fueling assembly as defined in claim 1, wherein fueling cavity is at least partially formed in said top portion and said side portion of said housing.

3. The fueling assembly as defined in claim 1, wherein said fuel level sensor assembly at least partially extends through said filler tube and at least partially into said fuel tank.

4. The fueling assembly as defined in claim 1, wherein said fuel level sensor assembly includes a fuel gauge, said fuel gauge positioned in said fueling cavity and positioned adjacent said filler tube.

5. The fueling assembly as defined in claim 3, wherein said fuel level sensor assembly includes a fuel gauge, said fuel gauge positioned in said fueling cavity and positioned adjacent said filler tube.

6. The fueling assembly as defined in claim 4, wherein said filler tube includes an opening, said filler tube opening positioned above said fuel gauge.

7. The fueling assembly as defined in claim 1, wherein said grommet is a one piece structure.

8. The fueling assembly as defined in claim 1, wherein said opening in said lower intermediate section providing access to at least a portion of said fuel level sensor assembly.

9. The fueling assembly as defined in claim 5, wherein said opening in said lower intermediate section providing access to at least a portion of said fuel level sensor assembly.

10. The fueling assembly as defined in claim 1, wherein said side section of said grommet has top and front edges and an outwardly extending flange connected to said top and front edges.

11. The fueling assembly as defined in claim 9, wherein said side section of said grommet has top and front edges and an outwardly extending flange connected to said top and front edges.

12. The fueling assembly as defined in claim 10, wherein said flange is not connected said lower intermediate section.

13. The fueling assembly as defined in claim 11, wherein said flange is not connected said lower intermediate section.

14. The fueling assembly as defined in claim 1, wherein said side section of said grommet has a substantially linear top portion formed into a U-shape and a curved base portion, said lower intermediate section having a curved portion that merges with said curved base portion.

15. The fueling assembly as defined in claim 13, wherein said side section of said grommet has a substantially linear top portion formed into a U-shape and a curved base portion, said lower intermediate section having a curved portion that merges with said curved base portion.

16. The fueling assembly as defined in claim 14, wherein said base portion of said side section has a first radius of curvature, said curved portion of said lower intermediate section has a second radius of curvature, said first and second radius of curvatures being substantially the same.

17. The fueling assembly as defined in claim 15, wherein said base portion of said side section has a first radius of curvature, said curved portion of said lower intermediate section has a second radius of curvature, said first and second radius of curvatures being substantially the same.

18. The fueling assembly as defined in claim 1, wherein said grommet includes a sealing structure positioned in said opening of said lower intermediate section, said sealing structure including a flexible flap which at least partially engages said filler tube to at least partially form a seal with said filler tube.

19. The fueling assembly as defined in claim 17, wherein said grommet includes a sealing structure positioned in said opening of said lower intermediate section, said sealing structure including a flexible flap which at least partially engages said filler tube to at least partially form a seal with said filler tube.

20. The fueling assembly as defined in claim 18, wherein said flexible flap at least partially engages a portion of said fuel level sensor assembly to at least partially form a seal with said fuel level sensor assembly.

21. The fueling assembly as defined in claim 19, wherein said flexible flap at least partially engages a portion of said fuel level sensor assembly to at least partially form a seal with said fuel level sensor assembly.

22. The fueling assembly as defined in claim 18, wherein sealing structure includes a filler cavity formed by a cavity wall extending downwardly from said opening in said lower intermediate section.

23. The fueling assembly as defined in claim 21, wherein sealing structure includes a filler cavity formed by a cavity wall extending downwardly from said opening in said lower intermediate section.

24. The fueling assembly as defined in claim 18, wherein sealing structure includes a filler cavity formed by a cavity wall extending upwardly from said opening in said lower intermediate section, said flexible flap connected to cavity wall and at least partially spaced above said lower intermediate section.

25. The fueling assembly as defined in claim 23, wherein sealing structure includes a filler cavity formed by a cavity wall extending upwardly from said opening in said lower intermediate section, said flexible flap connected to cavity wall and at least partially spaced above said lower intermediate section.

26. The fueling assembly as defined in claim 1, wherein said filler tube opening is positioned at or above a top of said grommet side wall section.

27. The fueling assembly as defined in claim 25, wherein said filler tube opening is positioned at or above a top of said grommet side wall section.

28. The fueling assembly as defined in claim 1, wherein a top of said fuel level sensor assembly is positioned at or below the top of said grommet side wall section.

29. The fueling assembly as defined in claim 27, wherein a top of said fuel level sensor assembly is positioned at or below the top of said grommet side wall section.

30. The fueling assembly as defined in claim 1, wherein said grommet includes a positioning stub secured to a bottom surface of said lower intermediate section, said positioning stub adapted to be inserted into a hole in said housing.

31. The fueling assembly as defined in claim 1, wherein said lower intermediate section of said grommet slopes downwardly when positioned in said fueling cavity.

32. The fueling assembly as defined in claim 29, wherein said lower intermediate section of said grommet slopes downwardly when positioned in said fueling cavity.

33. The fueling assembly as defined in claim 18, wherein said cavity wall includes at least one support rib.

34. The fueling assembly as defined in claim 33, wherein said support rib is at least partially positioned below said opening in said lower intermediate section of said grommet.

35. A grommet adapted to be inserted in a fueling cavity of a housing of an engine driven device to at least partially seal the fueling cavity to inhibit fluids entering the interior of the housing, said grommet comprising a side section and a lower intermediate section, said lower intermediate section including an opening adapted to provide access to at least a portion of a filler tube, said lower intermediate section having a front edge that is connected to a lip, at least a majority of said front edge of said lower intermediate portion connected to said lip, said lip extending outwardly at least about 0.0625 inch from said front edge of said lower intermediate portion.

36. The grommet as defined in claim 35, wherein said grommet is a one piece structure.

37. The grommet as defined in claim 35, wherein said side section of said grommet has top and front edges and an outwardly extending flange connected to said top and front edges.

38. The grommet as defined in claim 36, wherein said side section of said grommet has top and front edges and an outwardly extending flange connected to said top and front edges.

39. The grommet as defined in claim 37, wherein said flange is not connected said lower intermediate section.

40. The grommet as defined in claim 38, wherein said flange is not connected said lower intermediate section.

41. The grommet as defined in claim 35, wherein said side section of said grommet has a substantially linear top portion formed into an arcuate shape and a curved base portion, said lower intermediate section has a curved portion that merges with said curved base portion.

42. The grommet as defined in claim 40, wherein said side section of said grommet has a substantially linear top portion formed into an arcuate shape and a curved base portion, said lower intermediate section has a curved portion that merges with said curved base portion.

43. The grommet as defined in claim 41, wherein said base portion of said side section has a first radius of curvature, said curved portion of said lower intermediate section has a second radius of curvature, said first and second radius of curvatures being substantially the same.

44. The grommet as defined in claim 42, wherein said base portion of said side section has a first radius of curvature, said curved portion of said lower intermediate section has a second radius of curvature, said first and second radius of curvatures being substantially the same.

45. The grommet as defined in claim 35, wherein said grommet includes a sealing structure positioned in said opening of said lower intermediate section, said sealing structure including a flexible flap which is adapted to at least partially engage said filler tube to at least partially form a seal with said filler tube.

46. The grommet as defined in claim 44, wherein said grommet includes a sealing structure positioned in said opening of said lower intermediate section, said sealing structure including a flexible flap which is adapted to at least partially engage said filler tube to at least partially form a seal with said filler tube.

47. The grommet as defined in claim 45, wherein said flexible flap is adapted to at least partially engage a portion of a fuel level sensor assembly to at least partially form a seal with the fuel level sensor assembly.

48. The grommet as defined in claim 45, wherein sealing structure includes a filler cavity formed by a cavity wall extending downwardly from said opening in said lower intermediate section.

49. The grommet as defined in claim 46, wherein sealing structure includes a filler cavity formed by a cavity wall extending downwardly from said opening in said lower intermediate section.

50. The grommet as defined in claim 45, wherein sealing structure includes a filler cavity formed by a cavity wall extending upwardly from said opening in said lower intermediate section, said flexible flap connected to cavity wall and at least partially spaced above said lower intermediate section.

51. The grommet as defined in claim 49, wherein sealing structure includes a filler cavity formed by a cavity wall extending upwardly from said opening in said lower intermediate section, said flexible flap connected to cavity wall and at least partially spaced above said lower intermediate section.

52. The grommet as defined in claim 51, wherein said flexible flap is adapted to at least partially engage a portion of a fuel level sensor assembly to at least partially form a seal with the fuel level sensor assembly.

53. The grommet as defined in claim 35, wherein said grommet includes a positioning stub secured to bottom surface of said lower intermediate section, said positioning stub adapted to be inserted into a hole in said housing.

54. The grommet as defined in claim 35, wherein said lower intermediate section of said grommet slopes downwardly when positioned in said fueling cavity.

55. The grommet as defined in claim 52, wherein said lower intermediate section of said grommet slopes downwardly when positioned in said fueling cavity.

56. The grommet as defined in claim 48, wherein said cavity wall includes at least one support rib.

57. The grommet as defined in claim 56, wherein said support rib is at least partially positioned below said opening in said lower intermediate section of said grommet.

58. A fueling assembly for a fuel tank of an engine driven device, said engine driven device including a housing having a top portion, at least one side portion, a fueling cavity, an engine, a fuel tank which supplies fuel to the engine, and a grommet adapted to be at least partially positioned in said fueling cavity; said fueling assembly including a filler tube used to fill said fuel tank, said filler tube extending into said fueling cavity in said housing, said grommet at least partially sealing said fueling cavity to inhibit fluids entering an interior of said housing, said grommet having a side section and a lower intermediate section, said lower intermediate section including an opening to provide access to at least a portion of said filler tube, said lower intermediate section having a front edge that is connected to a lip, at least a majority of said front edge of said lower intermediate portion connected to said lip, said lip extending outwardly at least about 0.0625 inch from said front edge of said lower intermediate portion.

59. The fueling assembly as defined in claim 58, wherein fueling cavity is at least partially formed in said top portion and said side portion of said housing.

60. The fueling assembly as defined in claim 58, wherein said filler tube includes an opening, said opening positioned at or above said side section of said grommet.

61. The fueling assembly as defined in claim 58, wherein said grommet is a one piece structure.

62. The fueling assembly as defined in claim 58, wherein said side section of said grommet has top and front edges and an outwardly extending flange connected to said top and front edges.

63. The fueling assembly as defined in claim 62, wherein said flange is not connected said lower intermediate section.

64. The fueling assembly as defined in claim 58, wherein said side section of said grommet has a substantially linear top portion formed into an arcuate shape and a curved base portion, said lower intermediate section has a curved portion that merges with said curved base portion.

65. The fueling assembly as defined in claim 64, wherein said base portion of said side section has a first radius of curvature, said curved portion of said lower intermediate section has a second radius of curvature, said first and second radius of curvatures being substantially the same.

66. The fueling assembly as defined in claim 58, wherein said grommet includes a sealing structure positioned in said opening of said lower intermediate section, said sealing structure including a flexible flap which at least partially engages said filler tube to at least partially form a seal with said filler tube.

67. The fueling assembly as defined in claim 66, wherein sealing structure includes a filler cavity formed by a cavity wall extending downwardly from said opening in said lower intermediate section.

68. The fueling assembly as defined in claim 66, wherein sealing structure includes a filler cavity formed by a cavity wall extending upwardly from said opening in said lower intermediate section, said flexible flap connected to cavity wall and at least partially spaced above said lower intermediate section.

69. The fueling assembly as defined in claim 58, wherein said grommet includes a positioning stub secured to bottom surface of said lower intermediate section, said positioning stub adapted to be inserted into a hole in said housing.

70. The fueling assembly as defined in claim 58, wherein said lower intermediate section of said grommet slopes downwardly when positioned in said fueling cavity.

71. The fueling assembly as defined in claim 67, wherein said cavity wall includes at least one support rib.

72. The fueling assembly as defined in claim 71, wherein said support rib is at least partially positioned below said opening in said lower intermediate section of said grommet.

73. A grommet adapted to be inserted in a fueling cavity of a housing of an engine driven device to at least partially seal the fueling cavity to inhibit fluids from entering the interior of the housing, said grommet being a one piece structure comprising a side section and a lower intermediate section, said lower intermediate section including an opening, said lower intermediate section having a front edge that is connected to a lip, at least a majority of said front edge of said lower intermediate portion connected to said lip, said lip extending outwardly at least about 0.0625 inch from said front edge of said lower intermediate portion.

74. The grommet as defined in claim 73, wherein said opening in said lower intermediate section adapted to provide access to at least a portion of a filler tube.

75. The grommet as defined in claim 73, wherein said opening in said lower intermediate section adapted to provide access to at least a portion of a fuel level sensor assembly.

76. The grommet as defined in claim 73, wherein said side section of said grommet has top and front edges and an outwardly extending flange connected to said top and front edges.

77. The grommet as defined in claim 76, wherein said flange is not connected said lower intermediate section.

78. The grommet as defined in claim 73, wherein said side section of said grommet has a substantially linear top portion formed into an arcuate shape and a curved base portion, said lower intermediate section has a curved portion that merges with said curved base portion.

79. The grommet as defined in claim 78, wherein said base portion of said side section has a first radius of curvature, said curved portion of said lower intermediate section has a second radius of curvature, said first and second radius of curvatures being substantially the same.

80. The grommet as defined in claim 73, wherein said grommet includes a sealing structure positioned in said opening of said lower intermediate section, said sealing structure including a flexible flap which is adapted to at least partially engage said filler tube to at least partially form a seal with said filler tube.

81. The grommet as defined in claim 80, wherein said flexible flap is adapted to at least partially engage a portion of said fuel level sensor assembly to at least partially form a seal with said fuel level sensor assembly.

82. The grommet as defined in claim 80, wherein sealing structure includes a filler cavity formed by a cavity wall extending downwardly from said opening in said lower intermediate section.

83. The grommet as defined in claim 80, wherein sealing structure includes a filler cavity formed by a cavity wall extending upwardly from said opening in said lower intermediate section, said flexible flap connected to cavity wall and at least partially spaced above said lower intermediate section.

84. The grommet as defined in claim 73, wherein said grommet includes a positioning stub secured to bottom surface of said lower intermediate section, said positioning stub adapted to be inserted into a hole in said housing.

85. The grommet as defined in claim 73, wherein said lower intermediate section of said grommet slopes downwardly when positioned in said fueling cavity.

86. The grommet as defined in claim 82, wherein said cavity wall includes at least one support rib.

87. The grommet as defined in claim 86, wherein said support rib is at least partially positioned below said opening in said lower intermediate section of said grommet.

88. A grommet adapted to be inserted in a fueling cavity of a housing of an engine driven device to at least partially seal the fueling cavity to inhibit fluids entering the interior of the housing, said grommet comprising a side section and a lower intermediate section, said lower intermediate section including an opening adapted to provide access to at least a portion of a filler tube, said lower intermediate section including a sloped surface that extends at least partially between a back end of said lower intermediate section and a front edge of said lower intermediate section and substantially uniformly slopes downwardly from said back end to said front edge of said lower intermediate section.

89. The grommet as defined in claim 88, including a lip connected to said front edge of said lower section, at least a majority of said front edge of said lower intermediate portion connected to said lip, said lip extending outwardly at least about 0.0625 inch from said front edge of said lower intermediate portion.

90. The grommet as defined in claim 89, wherein said lip has substantially the same slope as said lower intermediate section.

91. The grommet as defined in claim 89, wherein said lip is at least about 0.5 inch in length.

92. The grommet as defined in claim 88, wherein said side section of said grommet has top and front edges and an outwardly extending flange, said flange including at least three openings substantially symmetrically oriented along the length of the flange.

93. The grommet as defined in claim 92, wherein said flange has a width, said width being substantially uniform along the length of the flange.

94. The grommet as defined in claim 88, wherein said opening in said lower intermediate section being non-circular.

95. The grommet as defined in claim 88, wherein said lower intermediate section has a substantially uniform radius of curvature.

96. A one piece grommet adapted to be inserted in a fueling cavity of a housing of an engine driven device to at least partially seal the fueling cavity to inhibit fluids entering the interior of the housing, said grommet comprising a side section and a lower intermediate section, said side section having top and front edges and a flange connected to said top and front edges, said lower intermediate section including an opening adapted to provide access to at least a portion of a filler tube, said lower intermediate section having a front edge that is connected to a lip, at least a majority of said front edge of said lower intermediate portion connected to said lip, said lip extending outwardly at least about 0.0625 inch from said front edge of said lower intermediate portion.

97. The grommet as defined in claim 96, wherein said flange is not connected said lower intermediate section.

98. The grommet as defined in claim 96, wherein said side section of said grommet has a substantially linear top portion formed into an arcuate shape and a curved base portion, said lower intermediate section has a curved portion that merges with said curved base portion.

99. The grommet as defined in claim 97, wherein said side section of said grommet has a substantially linear top portion formed into an arcuate shape and a curved base portion, said lower intermediate section has a curved portion that merges with said curved base portion.

100. The grommet as defined in claim 98, wherein said base portion of said side section has a first radius of curvature, said curved portion of said lower intermediate section has a second radius of curvature, said first and second radius of curvatures being substantially the same.

101. The grommet as defined in claim 99, wherein said base portion of said side section has a first radius of curvature, said curved portion of said lower intermediate section has a second radius of curvature, said first and second radius of curvatures being substantially the same.

102. The grommet as defined in claim 96, wherein said grommet includes a sealing structure positioned in said opening of said lower intermediate section, said sealing structure including a flexible flap which is adapted to at least partially engage said filler tube to at least partially form a seal with said filler tube.

103. The grommet as defined in claim 101, wherein said grommet includes a sealing structure positioned in said opening of said lower intermediate section, said sealing structure including a flexible flap which is adapted to at least partially engage said filler tube to at least partially form a seal with said filler tube.

104. The grommet as defined in claim 103, wherein said flexible flap is adapted to at least partially engage a portion of a fuel level sensor assembly to at least partially form a seal with the fuel level sensor assembly.

105. The grommet as defined in claim 96, wherein said grommet includes a positioning stub secured to bottom surface of said lower intermediate section, said positioning stub adapted to be inserted into a hole in said housing.

106. The grommet as defined in claim 104, wherein said grommet includes a positioning stub secured to bottom surface of said lower intermediate section, said positioning stub adapted to be inserted into a hole in said housing.

107. The grommet as defined in claim 96, wherein said lower intermediate section of said grommet slopes downwardly from a back end to a front edge of said lower intermediate section when positioned in said fueling cavity.

108. The grommet as defined in claim 106, wherein said lower intermediate section of said grommet slopes downwardly from a back end to a front edge of said lower intermediate section when positioned in said fueling cavity.

109. The grommet as defined in claim 107, wherein said slope in said lower intermediate section is substantially uniform from said back end to said front edge of said lower intermediate section.

110. The grommet as defined in claim 108, wherein said slope in said lower intermediate section is substantially uniform from said back end to said front edge of said lower intermediate section.

111. The grommet as defined in claim 107, wherein said lip is sloped, said slope of said lip being substantially the same as said slope of said lower intermediate section.

112. The grommet as defined in claim 110, wherein said lip is sloped, said slope of said lip being substantially the same as said slope of said lower intermediate section.

* * * * *